United States Patent [19]

Shreiner

[11] Patent Number: 4,877,672

[45] Date of Patent: Oct. 31, 1989

[54] FLOOR MAT WITH RIGID RAILS JOINED BY LIVING HINGES

[75] Inventor: Thomas A. Shreiner, Muncy, Pa.

[73] Assignee: Construction Specialties, Inc., Cranford, N.J.

[21] Appl. No.: 255,733

[22] Filed: Oct. 11, 1988

[51] Int. Cl.[4] ..... B32B 3/10; E04C 1/30

[52] U.S. Cl. ..... 428/156; 428/217; 428/54; 428/58; 52/71; 52/177

[58] Field of Search ..... 52/71, 177, 593, 594; 15/215, 217; 428/53, 54, 217, 58, 156

[56] References Cited

U.S. PATENT DOCUMENTS

| | | | |
|---|---|---|---|
| Re. 32,061 | 1/1986 | Ellingson, Jr. | 52/177 X |
| 3,247,637 | 4/1966 | Robertson | 52/594 X |
| 3,460,860 | 8/1969 | Stevens, Jr. | 52/71 |
| 3,462,181 | 8/1969 | Lewis | 52/594 X |
| 4,029,834 | 6/1977 | Bartlett | 52/181 X |
| 4,381,324 | 4/1983 | Ellingson, Jr. | 428/54 X |
| 4,568,587 | 2/1986 | Balzer | 52/177 X |
| 4,654,245 | 3/1987 | Balzer et al. | 52/71 X |
| 4,663,903 | 5/1987 | Ellingson, Jr. | 52/177 X |
| 4,766,020 | 8/1988 | Ellingson, Jr. | 52/177 X |

*Primary Examiner*—David A. Scherbel
*Assistant Examiner*—Lan Mai
*Attorney, Agent, or Firm*—Braumbaugh, Graves, Donohue & Raymond

[57] ABSTRACT

A floor mat is composed of a multiplicity of rigid elongated rails arranged parallel to each other, each rail having a body portion adapted to receive a tread member and a coupling portion by which it is joined to an adjacent rail. The body and coupling portions are found by extrusion of a rigid high-impact strength thermoplastic polymeric material and are joined by a living hinge of a highly flexible thermoplastic elastomer formed by coextrusion with the body and coupling portions. Each rail includes at least two ribs along its underside laterally spaced apart from each other and adapted to support the rail on a surface, each rib being formed by coextrusion with the body and coupling portions and the living hinge of a soft, compressible thermoplastic polymeric material and serving as a cushion and an anti-slip element of the mat.

2 Claims, 2 Drawing Sheets

FLOOR MAT WITH RIGID RAILS JOINED BY LIVING HINGES

BACKGROUND OF THE INVENTION

It is a highly advisable and almost universal practice to provide floor mats at the entrances to buildings to remove dirt from the footwear of persons entering the building. One form of entrance floor mat widely used in commercial and industrial buildings is based on rigid, elongated rails arranged parallel to each other and joined in closely spaced relation by a hinge-type coupling that enables the mat to be rolled up so that the floor or walk under it can be cleaned. The rails have tread surfaces, which may be ribbed or toothed metal or plastic elements, grit materials or carpet pieces, that assist in cleaning dirt from footwear. The dirt removed by the tread surfaces tends to fall or be scraped into the gaps between the rails. Floor mats of the type described above are disclosed in U.S. Pat. Nos. 3,808,628 (Betts, 1974); 4,029,834 (Bartlett, 1977); 4,568,587 (Balzer, 1986); Re. 32,061 (Ellingson, Jr., 1986) and European Pat. No. 0,067,024 (Parsons, 1986). Construction Specialties, Inc., the assignee of the present invention, ("CS") has marketed a floor mat very similar to the one described in the Bartlett '834 patent under the trademark "Turfmat." The CS "Turfmat" product has rails produced by extrusion from a rigid polyvinyl chloride (PVC) and having, therefore, rigid ball and socket type couplings. The CS "Turfmat" product also has integral ribs on each rail that are formed of a softer vinyl than the rest of the rail by coextrusion with the rigid vinyl of the rail bodies and coupling portions. The softer ribs provide a cushioning effect and also impart a non-slip property. While the "Turfmat" PVC mats have given reasonably good service and are less expensive than mats having aluminum rails, they are less durable than the aluminum mats.

The floor mats described in the Balzer '587 are currently marketed by Balco, Inc. (the assignee). The Balco mats have aluminum rails and "hinge members" formed of a relatively highly plasticized PVC, a flexible thermoplastic. The hinge members allow the mat to be rolled up by flexing throughout the extent of the transverse span between the aluminum rails and also by articulation at the ball and socket joints by which the hinge members are linked to the rails. Because the hinge members of the Balco mats have, like most mats of the rail type, holes to allow dirt and water to fall to the floor or other surface under the mat, the flexure of the PVC hinge members is concentrated at the segments that are aligned with the holes. The concentrated flexure is accompanied by increased stress. Under repeated flexure the highly stressed regions begin to fail. Eventually, an entire hinge member breaks apart, and the mat must be repaired or replaced.

The mats of the Parsons European patent have hinge members much like those of the Balco mats except that it is proposed that they be made of rubber. Stress concentration and fatigue failure are likewise a potential, though rubber should have greater durability than flexible PVC. However, rubber is generally more elastic than flexible PVC, and mats made according to the Parsons patent would probably be prone to transverse dimensional instability due to creaping of the rails toward or away from each other because of the elasticity of the rubber hinge members.

Assembly of the Balco and Parsons mats is tedious, because the hinge members are separate from the rails. For a given number of rails there are twice as many parts to be assembled by endwise sliding than in a mat in which the rail bodies are integral with the connector elements, such as the CS "Turfmat" and the CS "Pedimat" aluminum mats made according to the Bartlett '834 patent. Also, each rail has to be locked endwise to each hinge member, such as by rivets, and twice as many connections are required in the Balco mats as in the CS mats.

SUMMARY OF THE INVENTION

An object of the present invention is to provide a floor mat composed of rails in which the bodies and connectors are unitary and which is more durable than the "Turfmat," less costly than the aluminum rail mats, light in weight, highly attractive in appearance and easy to assemble. Another object is to provide a floor mat in which the rails are not as stiff as the PVC and aluminum rails of currently available mats and thus more readily conform to irregularities in the floor or walk on which they are placed. Yet another object is to provide cushioning and non-slip properties by integrally formed elements of the rails.

The foregoing and other objects are attained, according to the present invention, by a floor mat composed of a multiplicity of rigid elongated rails arranged parallel to each other, each rail having a body portion adapted to receive a tread member and a coupling portion by which it is joined to an adjacent rail. The body portion and the coupling portion of each rail are formed by extension of a high-impact strength polymer. The body portion and coupling portion are joined by a living hinge of a flexible thermoplastic elastomer formed by coextrusion with the body portion and coupling portion. In a preferred embodiment, the body portion of each rail includes at least two ribs along its underside laterally spaced apart from each other and adapted to support the rail on a surface, each rib being formed by coextrusion with the body and coupling portions and the living hinge of a relatively soft and compressible thermoplastic polymeric and serving as a cushion and an anti-slip element of the mat.

For a better understanding of the invention, reference may be made to the following description of an embodiment, taken in conjunction with the accompanying drawings.

DESCRIPTION OF THE EMBODIMENT

Figure 3:
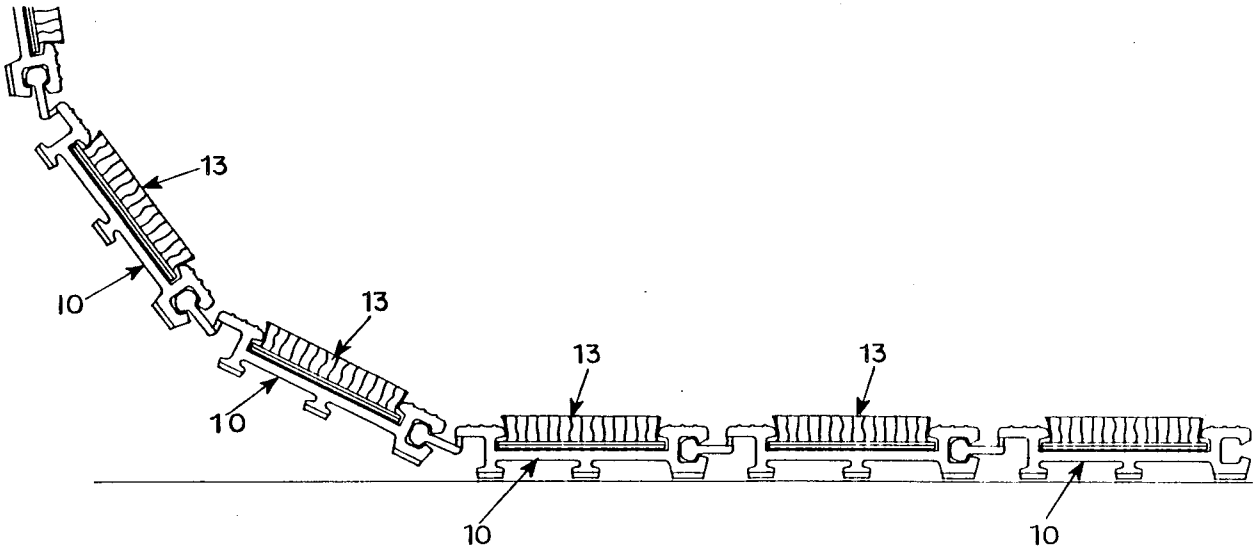
FIG. 3 is an end view of a section of the mat and shows on the left side how the adjacent rails articulate when the mat is rolled up.

The embodiment closely resembles the floor mat described and shown in the Bartlett '834 patent, which is incorporated by reference into the present specification. In particular, it comprises side-by-side, parallel rails 10, each of which has a body portion 12 adapted to receive a tread element 13 (see FIG. 3) and an integral coupling portion 14 by which it is joined to an adjacent rail through a ball and socket arrangement. Each rail is of uniform cross-section along its length and is produced by extrusion. The body has a recess 16 opening upwardly and defined on either side by an overhanging lip 18. The lips retain a carpet strip or some other form of tread element 13 in the recess, as is well known per se.

On one edge of the rail member body is a flange portion 20 of generally C-shaped cross-section that defines a socket 22. A connector formation 24 on the coupling portion 14 in the general shape in cross-section of a ball fits into the socket 22 of the adjacent rail. The opening slot 26 of the socket 22 is wider than the web part 28 of the coupling portion 14 of the rail, which allows each rail to articulate about the longitudinal axis of the ball and socket coupling when the mat is rolled up. The web part 28 has elongated holes 30 uniformly spaced along its length for passage of dirt and water removed by the treads of the mat to the floor or other surface on which the mat is placed in use. Longitudinal ribs 32 on the marginal upper surfaces of the rail body assist the tread elements in removing dirt and impart a non-slip characteristic. As described thus far, the embodiment employs well-known features of floor mats that have enjoyed considerable commercial success and have met a need for a durable, attractive, economical and easy-to-use entrance mat.

Figure 1:
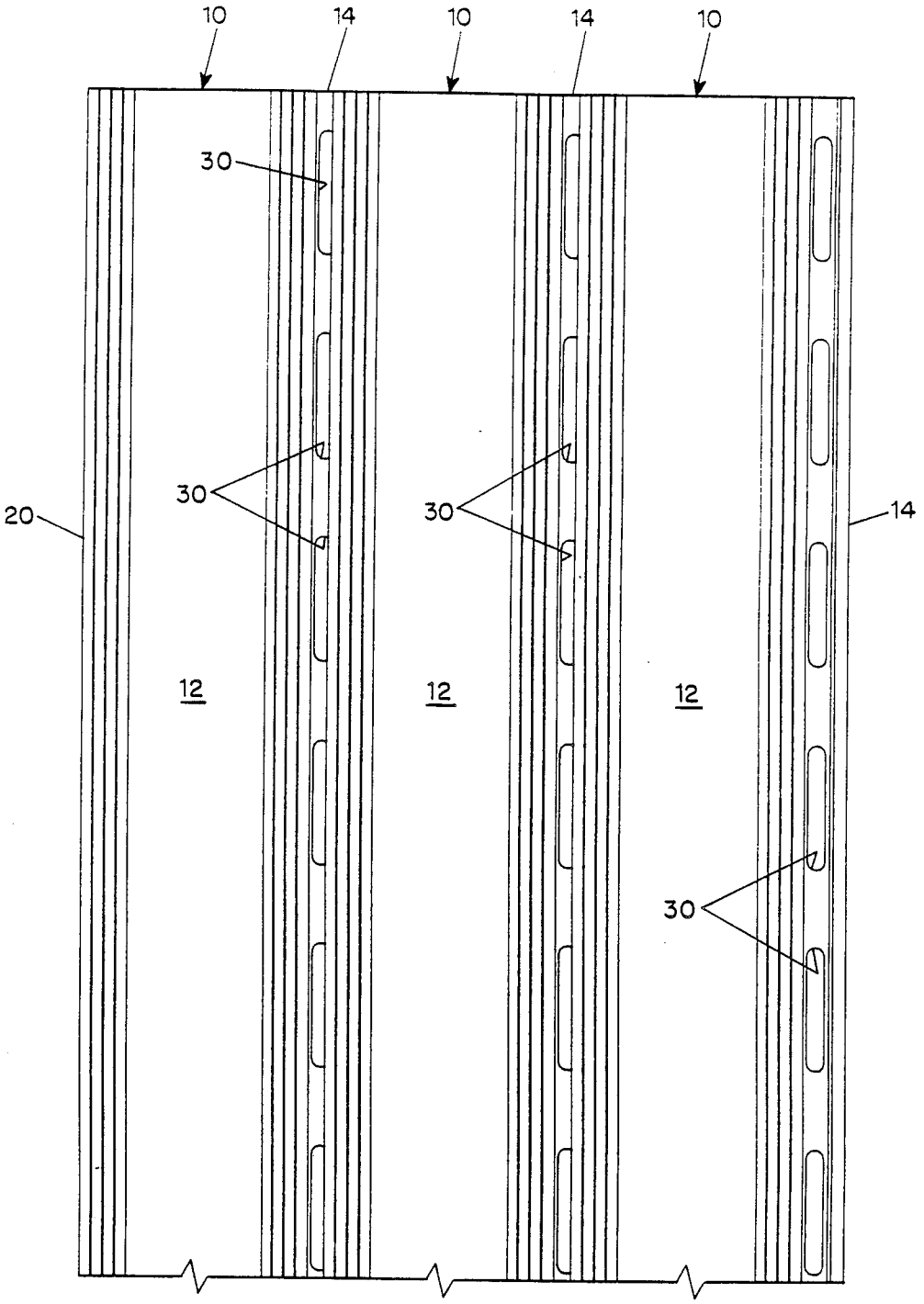
FIG. 1 is a top plan view of a section of a floor mat according to the invention.
Figure 2:
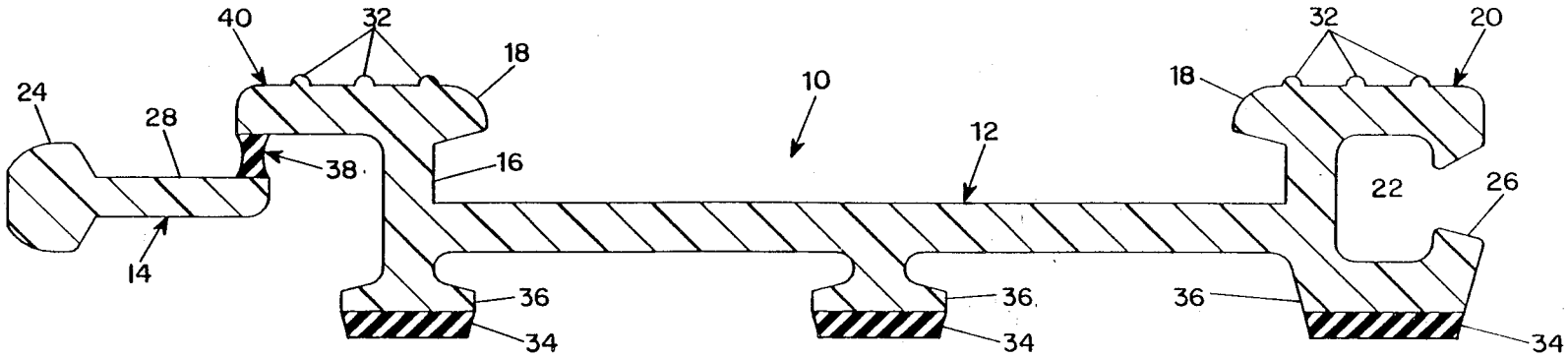
FIG. 2 is an end cross-sectional view of a rail of the mat shown on a larger scale than FIG. 1.

In accordance with the present invention, the rails 10 are made by coextrusion of different thermoplastic polymeric materials, the differently cross-hatched regions of FIG. 2 representing those different materials. The body portion 12 and connector portion 14 are both formed of a rigid high-impact strength thermoplastic polymeric material. A polymeric material having an Izod impact strength, ⅛th inch notch, of not less than 16 ft./lb./in., a Shore D hardness of about 80 and a tensile yield strength of at least 6000 psi is preferred. Acrylic-modified polyvinyl chloride polymers with these properties are commercially available.

The lower extremities 34 of the three ribs or feet 36 of the rail, which support the rail on the floor, are made of a soft, compressible thermoplastic polymeric material to provide a cushioning effect and impart a non-slip characteristic. A polymeric material having a modulus of rigidity less than 16,000 psi at −49° F., a percent elongation of more than 300% and a Shore A hardness of between 60 and 80 is preferred. Commercially available acrylic-modified polyvinyl chlorides with these properties are suitable.

The coupling portion 14 of the rail is joined to the body portion 12 by a living hinge portion 38, which is in the form of a longitudinally continuous thin strand of a soft, flexible thermoplastic elastomer compound that exhibits high endurance to flexural fatigue. Thermoplastic elastomers suitable for living hinges, such as polyurethane elastomers, are commercially available. It is preferred that the elastomer have an elongation of at least 500%, a modulus of rigidity at −45° F. of less than 1750 psi and a Shore A hardness in the range of 60 to 80. The tensile strength should be as high as possible, say at least 3000 psi at yield. Of course, the flexural endurance to withstand many hundreds of cycles of rolling and unrolling of the mat is essential.

As is known per se, the living hinge portion 38 is of hour-glass shape, which creates a zone of bending without stress risers and a comparatively large areas of joinder to the adjacent rigid parts. The configuration of the embodiment, in which the rigid portions joined by the living hinge portion are offset vertically, is merely exemplary. The living hinge may be interposed anywhere in the transverse gap between the rail body 12 and the rigid coupling ball portion 24. For example it may be located immediately adjacent the ball portion 24 or interposed in the web portion 28. The top flange 40 with the ribs 32 is not essential to the rail structurally or functionally, and the web 28 could extend horizontally all the way from the ball 24 to the body 12, in which case the living hinge could be at the juncture of the body with the web or could be anywhere along the width of the web. More than on living hinge could be provided in the gap between the coupling portions. It is preferred, however, that the living hinge not be in line with the holes 30 (which, incidentally, are punched out of the extruded member) because they would then be segmental and more prone to failure. The illustrated embodiment includes the upper flange 40 as a desirable appearance feature—as seen from the top, the rails are symmetrical. Finally, the compound used for the living hinge may be transparent, in which case it is desirable that it be largely invisible, lest it be perceived as a gap (though it is very small and not likely to be observed in use, no matter where it is located).

Except for the living hinge portion, the rails can be pigmented or dyed in any desired color. The color extends throughout the material, so scratches and other surface damage will hardly show. For outdoor use, UV inhibitors should be incorporated.

The mat is assembled by sliding successive rails endwise onto the last rail of the partly assembled mat. One or more fusion joints (not shown) is made between the ball-and-socket elements of each juncture between rails to join them against lengthwise relative movement. In regions near the fusion joints, the balls and sockets cannot articulate, and rolling up of the mat is permitted by flexure of the living hinge. In regions of the junctures remote from the fusion joints, rolling up of the mat is afforded by a combination of flexure of the living hinges and articulation of the ball and socket joints. The moderate flexibility of the polymeric materials of the mat affords moderate deformation of the coupling portions of the rails, which in turn progressively diminishes the effect of the rotational restraints of the fusion joints, the greater the distance from the fusion joint. The moderate flexibility of the polymeric materials also allows the rails to conform somewhat by flexure to irregular surfaces in the lengthwise direction. The living hinges and ball and socket joints readily allow conformity to the supporting surface in the transverse direction. The soft thermoplastic on the feet of the rails also provides local compliance with slightly rough or uneven surfaces.

I claim:

1. In a floor mat composed of a multiplicity of rigid elongated rails arranged parallel to each other, each rail having a body portion adapted to receive a tread member and a coupling portion by which it is joined to an adjacent rail, the body and coupling portions being a monolithic formation produced by extrusion from a thermoplastic polymeric material, the improvement wherein the body portion and the coupling portion of each rail are formed by extrusion of a rigid high-impact strength thermoplastic polymeric material and wherein the body portion and coupling portion of each rail are joined by a living hinge in the form of a longitudinally continuous thin strand of a highly flexible thermoplastic elastomer coextruded with the body portion and coupling portion and forming a distinct bending line for articulation of the body portion relative to the coupling portion.

2. The improvement according to claim 1 wherein the body portion of each rail includes at least two ribs along its underside laterally spaced apart from each other and adapted to support the rail on a surface, each rib being formed by coextrusion with the body portion, coupling portion and the living hinge of a soft compressible thermoplastic polymeric material and serving as a cushioning and anti-slip element of the mat.

* * * * *